US010556170B2

(12) United States Patent
Aleman et al.

(10) Patent No.: US 10,556,170 B2
(45) Date of Patent: Feb. 11, 2020

(54) CLAMP FOR ATTACHING ACCESSORIES TO A SKATEBOARD OR LONGBOARD

(71) Applicants: Evelio Aleman, Miami, FL (US); Guillermo Aleman, Miami, FL (US)

(72) Inventors: Evelio Aleman, Miami, FL (US); Guillermo Aleman, Miami, FL (US)

( * ) Notice: Subject to any disclaimer, the term of this patent is extended or adjusted under 35 U.S.C. 154(b) by 0 days.

(21) Appl. No.: 16/051,970

(22) Filed: Aug. 1, 2018

(65) Prior Publication Data

US 2019/0091555 A1 Mar. 28, 2019

Related U.S. Application Data

(60) Provisional application No. 62/563,208, filed on Sep. 26, 2017.

(51) Int. Cl.
*A63C 17/01* (2006.01)
*A63C 17/26* (2006.01)

(52) U.S. Cl.
CPC ..... *A63C 17/26* (2013.01); *A63C 17/017* (2013.01); *A63C 17/265* (2013.01)

(58) Field of Classification Search
CPC ..... A63C 17/0006; A63C 17/0013; A63C 17/011; A63C 17/012; A63C 17/013; A63C 17/014; A63C 17/015; A63C 17/017; A63C 17/02; A63C 17/26; A63C 17/262; A63C 17/265; A63C 17/267; F16L 3/00; F16L 3/08; F16L 3/085; F16L 3/10; F16L 3/1008; F16L 3/1016; F16L 3/1025; F16L 3/1091
USPC ..... 29/890.141
See application file for complete search history.

(56) References Cited

U.S. PATENT DOCUMENTS 492,593 A * 2/1893 Taylor ..... F16L 3/1091 248/74.4
1,777,884 A * 10/1930 Horix ..... B62J 6/02 248/230.5
2,197,728 A * 4/1940 Lee ..... F16L 3/1091 248/70
2,937,835 A * 5/1960 Csmereka ..... F16L 3/1091 248/74.4
3,349,741 A * 10/1967 Herbst ..... B63B 35/795 114/39.22
3,487,800 A * 1/1970 Drake ..... B63B 35/7959 114/39.15
3,856,244 A * 12/1974 Menshen ..... F16L 3/237 248/67.5
3,982,766 A * 9/1976 Budge ..... A63C 17/01 280/1

(Continued)

*Primary Examiner* — Joshua E Rodden

(57) ABSTRACT

A clamp used to attach an accessory to a skateboard or longboard. The clamp, in its preferred embodiment, consists of a mounting plate, a clamp bottom, and a clamp top. The mounting plate is used to attach to the top deck of the skateboard or longboard using the existing truck hole mounting pattern. The clamp bottom will attach to the mounting plate and the clamp top will attach to the clamp bottom with an accessory secured between the clamp bottom and top. It is understood that the pieces of the clamp can be attached using various methods and construction methods can vary. The purpose of this clamp is to allow the rider of a skateboard or longboard ability to attach accessories to a board. With the attachment of an accessory, a rider has the flexibility to customize their board to meet their needs and create a hybrid modular board.

11 Claims, 2 Drawing Sheets

(56) References Cited

U.S. PATENT DOCUMENTS 4,130,292 A * 12/1978 Lorenz ..... A63C 17/01 280/810
4,134,600 A * 1/1979 McDonald ..... A63C 5/035 280/11.28
4,172,578 A * 10/1979 Pate ..... F16L 3/1075 248/74.3
4,270,250 A * 6/1981 Schon ..... F16L 3/1091 24/114.5
4,444,370 A * 4/1984 Krueger ..... F16L 3/08 206/443
5,215,281 A * 6/1993 Sherman ..... F16L 3/1207 248/219.4
5,931,504 A * 8/1999 Armitage ..... A63C 5/11 280/14.21
6,173,926 B1 * 1/2001 Elvegaard ..... F16L 3/237 248/74.1
6,308,921 B1 * 10/2001 Borzucki ..... F16L 3/237 248/68.1
6,719,255 B2 * 4/2004 Chen ..... H04R 1/026 248/214
9,601,241 B2 * 3/2017 Dannenberg ..... H01B 17/24
9,822,907 B1 * 11/2017 Hennon ..... F16M 13/02
10,221,994 B2 * 3/2019 Baiera ..... E04H 12/22
2001/0023911 A1 * 9/2001 Kommers ..... F16L 3/1091 248/74.1
2006/0027713 A1 * 2/2006 van Walraven ..... F16L 3/1091 248/56
2011/0005044 A1 * 1/2011 Hancock ..... F16L 3/1091 24/458
2012/0217353 A1 * 8/2012 Hennon ..... F16L 3/1091 248/67.5
2014/0251072 A1 * 9/2014 LaBrie ..... B62B 5/06 74/551.4
2018/0038518 A1 * 2/2018 Hennon ..... F16M 13/027
2018/0333634 A1 * 11/2018 Aleman ..... A63C 17/265

* cited by examiner

CLAMP FOR ATTACHING ACCESSORIES TO A SKATEBOARD OR LONGBOARD

CROSS REFERENCE OF RELATED APPLICATIONS

This application claims the benefit of our U.S. Provisional Application No. 62/563,208 filed on Sep. 26, 2017, and entitled "CLAMP FOR HANDLEBAR".

This application is related to U.S. Non-Provisional application Ser. No. 15/983,086 filed on May 17, 2018, and entitled "HYBRID BOARD AND METHODS OF RIDING THE SAME".

BACKGROUND OF THE INVENTION

Riding a traditional skateboard or a traditional longboard has long been a popular activity for children and adults alike. The inventors, as avid skateboard riders, observed that the standard method of riding a skateboard or longboard is limited to a standing position. This limitation does not allow for flexibility of alternative riding positions or adjustments of positions while riding. The standard skateboard or longboard restricts variations of riding positions, riding styles, riding adaptations, or overall riding choices. Riders generally remain in the standing position. Although there are riders who attempt other riding positions, such as squatting, alternative riding positions minimize board control for the rider.

It was additionally observed that riders of skateboards or longboards, especially beginners or younger riders, faced stability and/or balancing issues. Stepping on a skateboard or longboard while stationary or standing while in motion can cause a rider, especially that of a beginner level or younger rider, to feel off balance. In actuality, there are individuals who never succeed to ride a skateboard or longboard in the standing position. These individuals fail to develop the balance, coordination, or stability necessary to accomplish riding. With the present, common method of riding, certain individuals, struggle while attempting to ride a skateboard or longboard.

Furthermore, the inventors witnessed riders exploring and attempting different riding positions on a skateboard or longboard, such as kneeling, squatting, or other variations. Being that a skateboard or a longboard was not designed for these variations in riding stances, it was observed that these riders had difficulty in board control or manipulation of their balance or the actual board while in motion in these variant riding positions. This lack of control increases the risk of injury. Riders electing to ride kneeling, squatted, or a variation did not have a safe hand placement location while in motion. Also, at times they used their hands to push off on the ground in order to move the board. The lack of a safe hand placement option or the use of the hands to push the board into motion also increases the risk of injury. Moreover, another method riders attempted was to sit on top of a skateboard or longboard, in an upright position, in order for another individual to push that rider while on the board. This riding preference likewise increases the risk of injury because the rider similarly does not have a safe way of holding on to the board or controlling the board. Overall, the inventors realized that these attempts of exploring alternatives to different riding positions, are not technically pursuant to the current design, purpose, proper usage or intended use of a skateboard or longboard and therefore increases the risk of injuries overall.

Presently, there is no solution to allow a rider of a longboard or skateboard flexibility or choices of having a variety of preferences in riding styles, riding adaptations, riding choices or riding positions; or to increase the control, stability, balance or safety of a rider while in use. With the invention of this clamp used to attach accessories such as but not limited to a handlebar, to a skateboard or longboard, riders will have a solution to this problem. There is no longer a limitation of riding in a standing position as the sole safe method.

As an example of its function, use of this clamp to attach an accessory such as a low-lying handlebar, riders will now have the ability and flexibility to safely ride a skateboard or longboard in different riding positions such as kneeling, squatted, sitting down, modified standing pose or even change throughout these positions while in motion. Using this clamp with a handlebar attached, increases safety for a beginner learning to ride a skateboard or longboard standing up. When this beginner rider feels off balance while standing, they now have a handlebar to lean over and grab. This beginner rider can also lean over to grab the handlebar, in a modified standing pose, and use one of their legs to push off to set the board into motion. The beginner rider can alternate between releasing the handlebar to stand and leaning over to grab the handlebar as needed while they develop their balance. Likewise, while riding the skateboard or longboard standing up, a rider can now squat down while in motion, grab the low-lying handlebar, and use their body weight to control the board. Furthermore, with a low-lying handlebar attached to the top deck, a rider can choose to ride kneeling. With their hands on the handlebar, a rider can place their knees on the skateboard or longboard and use one leg to push off. The handlebar, attached with the clamp, allows for safe hand placement and added board control. A rider can use their body weight to control the board. There is no longer a need for a rider to use their hands to push off to set the board in motion. Moreover, advanced riders can transition throughout different riding positions while using the low-lying handlebar attached with the clamp accordingly. Also, riders who enjoy sitting upright on top of the skateboard and longboard while another individual push them, similarly have safe hand placement and board control. Additionally, riders who have never succeeded in riding a skateboard or longboard standing up, are now given the ability to ride by implementing different riding positions. Moreover, the use and purpose of a skateboard or longboard has remained the same over time. Use of this clamp now modifies and/or enhances the riding experience as well as adds other functions by giving riders the ability to attach accessories to a longboard or skateboard, such as but not limited to, a variation of handlebars, basket, seat, motor, etc. Attachments can be used to customize a longboard or skateboard to meet their needs and ultimately creates a modular, hybrid board.

SUMMARY OF THE INVENTION

This invention seeks to provide a solution for the problems and limitation associated with riding a traditional skateboard or traditional longboard, as previously described, by providing a clamp that allows a user to attach different accessories, such as but not limited to a handlebar, to a skateboard or longboard. The clamp utilizes the existing truck mounting hole pattern, partial or whole, of a skateboard or longboard. The clamp can be used to mount an accessory without the need to open any additional holes on a skateboard or longboard. The clamp allows the user to convert a skateboard or longboard into a hybrid board by using all or any truck mounting hole pattern, partial or whole, that secure all or any of the trucks to the board, to attach an accessory, without the need to add additional holes or attach with the use of an adhesive or any other method of attachment. It is understood that the clamp could be attached to any part of the skateboard or longboard as desired.

DETAILED DESCRIPTION OF DRAWING IN PREFERRED EMBODIMENT

Figure 1:
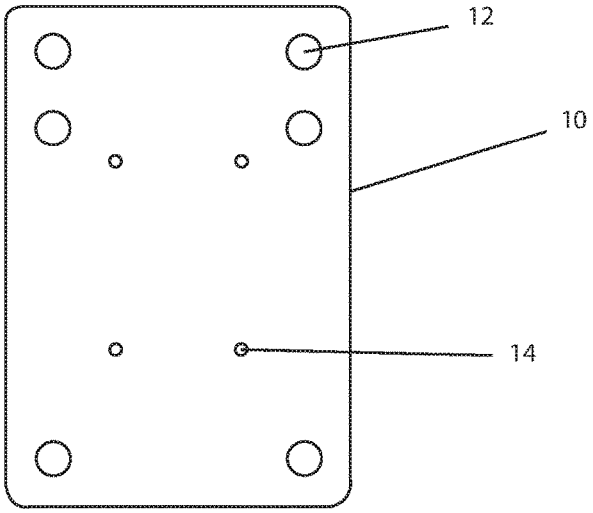
FIG. 1 is a top view of the mounting plate in its preferred embodiment.

While this invention is illustrated and described in a preferred embodiment, this description is not to be taken in limiting sense. The embodiment(s) of the present invention has been depicted in the drawings and will here be described in detail as a preferred embodiment. These descriptions merely serve the purpose of describing one or more preferred embodiments. It is understood that any single feature or combination features in any of the examples may constitute additional examples. These descriptions are not intended to limit the invention to the embodiment illustrated.

Figure 2:
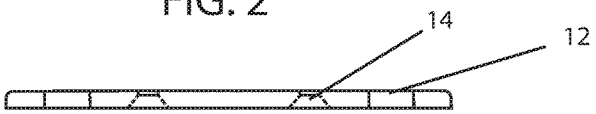
FIG. 2 is a section view of the mounting plate in its preferred embodiment.
Figure 3:
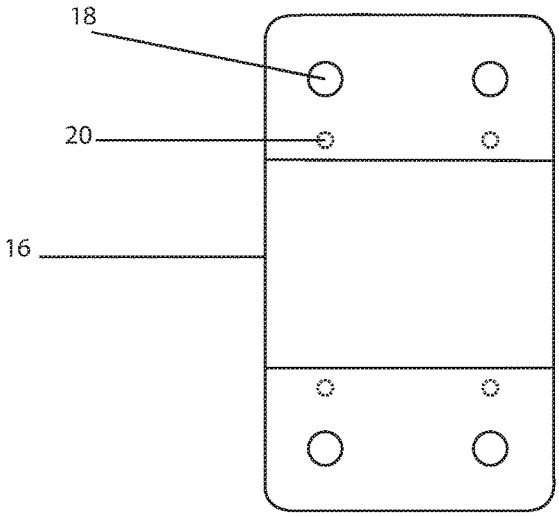
FIG. 3 is a top view of the clamp bottom in its preferred embodiment.
Figure 4:
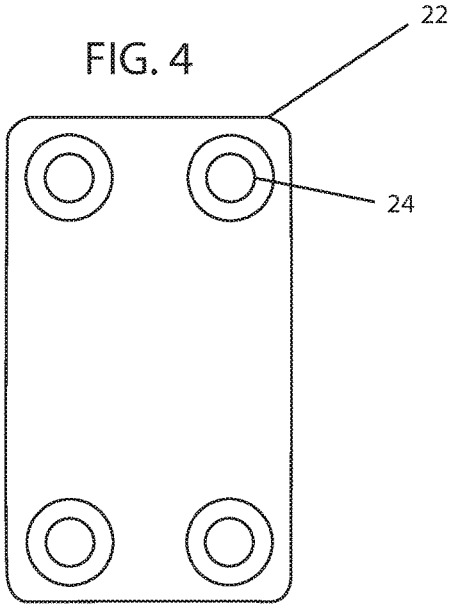
FIG. 4 is a top view of the clamp top in its preferred embodiment.
Figure 5:
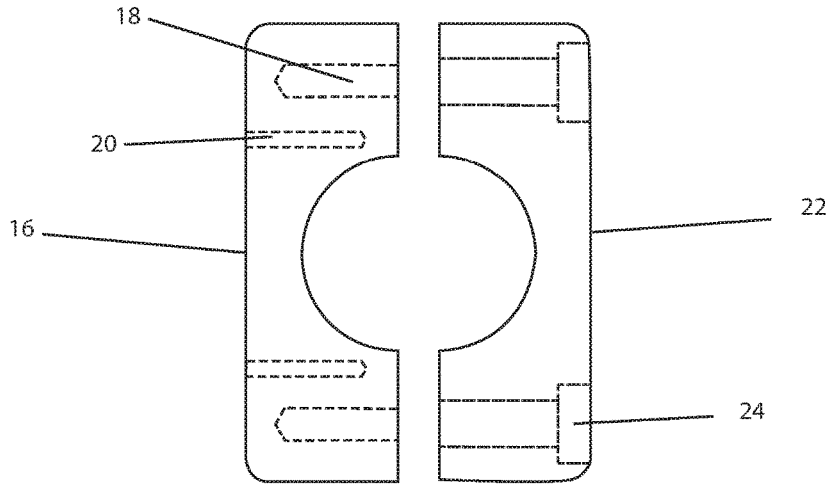
FIG. 5 is a side cross section view of the clamp top and clamp bottom in its preferred embodiment.
Figure 6:
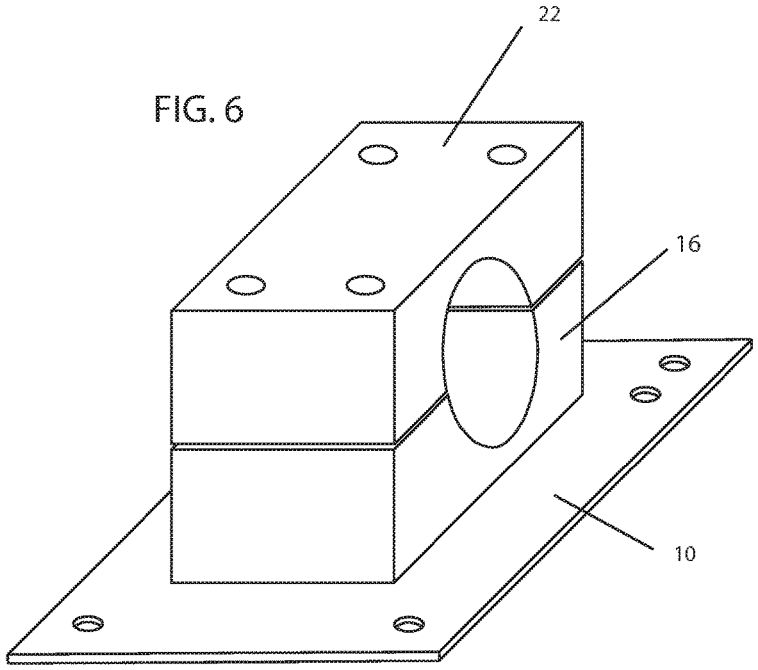
FIG. 6 is a perspective view of the mounting plate, clamp bottom, and clamp top in its preferred embodiment.

FIG. 1 shows the mounting plate 10 with the outer screw holes 12 and the inner screw holes 14. FIG. 2 shows a section view of the mounting plate 10 with outer screw holes 12 and inner screw holes 14. FIG. 3 shows the clamp bottom 16 with the top screw holes 18 and bottom screw holes 20. FIG. 4 shows the clamp top 22 with the screw holes 24. FIG. 5 shows a side cross section view of the clamp bottom 16 with top screw holes 18 and bottom screw holes 20 and the clamp top 22 with screw holes 24. FIG. 6 shows a perspective view of the mounting plate 10, the clamp bottom 16 and the clamp top 22.

The mounting plate 10 is attached to the skateboard or longboard using the existing truck mounting hole pattern on the top deck using the outer screw holes 12. The clamp bottom 16 is placed above the mounting plate 10 and attached using screw holes 14 and 20. The clamp top 22 is attached to the clamp bottom 16 using screw holes 18 and 24. The accessory will be secured between the clamp bottom 16 and the clamp top 22. The clamp top 22 and the clamp bottom 16, will tightly hold the accessory in place. It is foreseen that in other embodiments, the mounting of an accessory will allow for rotation or movement if so desired or for a specific function.

It is foreseen that in other embodiments there are other methods of securing the mounting plate 10, clamp bottom 16, and clamp top 22 or other such variations to one another as well as to the existing truck mounting hole pattern, partial or entire, of skateboards or longboards. It is foreseen that in other embodiments the appearance of the clamp can vary but will utilize the existing hole pattern, partial or entire, of any or all trucks of all or any longboard or skateboard.

It is foreseen that in other embodiments, this clamp can be attached or secured by various methods to other areas of a longboard or skateboard. It is foreseen that in other embodiments, the pieces that compose the clamp can be attached to one another using various procedures or constructed together, partially or as a whole unit. It is foreseen that in other embodiments, various materials can be used to compose this clamp such as but not limited to, aluminum, steel, plastic, titanium or other sturdy materials. Although the invention is illustrated with respect to a skateboard or longboard, the clamp could be used to attach an accessory to other wheeled riding devices or other riding devices such as but not limited to water boards, snowboards, etc.

Many other variations are possible for the stated purpose discussed. With the present invention thus explained, it is apparent that various modifications and variations can be made without departing from the scope and spirit of the present invention. Even though numerous characteristics of the present invention have been set forth in the preceding description, all disclosures are illustrative only. It is understood that changes may be made in detail, especially in matters of size, shape, arrangement, composition, assembly, attachment, and so on within the principles of the invention to the full extent as indicated by the broad general meanings of the terms expressed in the following claims.

What is claimed is:

1. A clamp in combination with one of a skateboard or longboard, the clamp comprising:

The skateboard or longboard including a plurality of truck mounting holes forming a truck mounting hole pattern;

The clamp further comprising:

a. a mounting plate, the mounting plate including a plurality of outer screw holes and a plurality of inner screw holes, wherein said outer screw holes match the truck mounting hole pattern of the skateboard or longboard;

b. a clamp bottom, the clamp bottom has a plurality of top screw holes and a plurality of bottom bottom screw holes, wherein the bottom screw holes match the inner screw holes of the mounting plate to attach the clamp bottom to the mounting plate, and wherein the clamp bottom includes an upward facing opening configured to hold an accessory;

c. a clamp top, the clamp top has a plurality of screw holes, wherein the screw holes of the clamp top match the top screw holes of the clamp bottom to attach the clamp top to the clamp bottom, and wherein the clamp top includes a downward facing opening matching the upward facing opening of the clamp bottom, and configured to hold the accessory.

2. The clamp in combination with one of a skateboard or longboard as described in claim 1, wherein the truck mounting hole pattern is one of a new school or old school pattern.

3. The clamp in combination with one of a skateboard or longboard as described in claim 1, wherein an accessory is secured between the clamp bottom and clamp top.

4. The clamp in combination with one of a skateboard or longboard as described in claim 1, wherein at least one of the mounting plate, the clamp top and the clamp bottom are constructed from at least one of aluminum, steel, plastic, or titanium.

5. The clamp in combination with one of a skateboard or longboard as described in claim 1, further including a plurality of fasteners which connect the mounting plate, the clamp top and the clamp bottom to one another.

6. The clamp in combination with one of a skateboard or longboard as described in claim 5, wherein the plurality of fasteners include screws.

7. A clamp in combination with one of a wheeled riding device, a water board or snow board, the clamp comprising:

The wheeled riding device, a water board or snow board including a plurality of mounting holes forming a truck mounting hole pattern;

The clamp further comprising:

a. a mounting plate, the mounting plate including a plurality of outer screw holes and a plurality of inner screw holes, wherein said outer screw holes match the mounting hole pattern of the wheeled riding device, a water board or snow board;

b. a clamp bottom, the clamp bottom has a plurality of top screw holes and a plurality of bottom bottom screw holes, wherein the bottom screw holes match the inner screw holes of the mounting plate to attach the clamp bottom to the mounting plate, and wherein the clamp bottom includes an upward facing opening configured to hold an accessory;

c. a clamp top, the clamp top has a plurality of screw holes, wherein the screw holes of the clamp top match the top screw holes of the clamp bottom to attach the clamp top to the clamp bottom, and wherein the clamp top includes a downward facing opening matching the upward facing opening of the clamp bottom, and configured to hold the accessory.

8. The clamp in combination with one of a wheeled riding device, a water board or snow board as described in claim 7, wherein an accessory is secured between the clamp bottom and clamp top.

9. The clamp in combination with one of a wheeled riding device, a water board or snow board as described in claim 7, wherein at least one of the mounting plate, the clamp top and the clamp bottom are constructed from at least one of aluminum, steel, plastic, or titanium.

10. The clamp in combination with one of a wheeled riding device, a water board or snow board as described in claim 7, further including a plurality of fasteners which connect the mounting plate, the clamp top and the clamp bottom to one another.

11. The clamp in combination with one of wheeled riding device, a water board or snow board as described in claim 10, wherein the plurality of fasteners include screws.

* * * * *